United States Patent [19]

George

[11] Patent Number: 4,491,450

[45] Date of Patent: Jan. 1, 1985

[54] PICK-UP AND LAYDOWN MACHINE

[76] Inventor: Albert L. George, 222 Grand Ave., Lafayette, La. 70503

[21] Appl. No.: 304,901

[22] Filed: Sep. 23, 1981

[51] Int. Cl.[3] ..... E21B 19/14

[52] U.S. Cl. ..... 414/22; 104/112; 104/126; 137/355.23; 212/189; 280/763.1; 294/65.5; 294/99 R; 414/910; 414/918

[58] Field of Search ..... 414/22, 745, 910, 918; 294/65.5, 78 R, 99 R, 101; 104/93, 112, 124, 125, 126; 137/355.16, 355.17, 355.2, 355.23, 355.24, 355.25; 212/189; 280/763.1

[56] References Cited

U.S. PATENT DOCUMENTS

| | | | |
|---|---|---|---|
| 2,776,856 | 1/1957 | Ingram | 294/101 X |
| 2,865,658 | 12/1958 | Dubuque | 280/475 |
| 2,913,276 | 11/1959 | Collings | 294/65.5 |
| 3,350,129 | 10/1967 | Novak | 294/67 R |
| 3,420,546 | 1/1969 | Jasovsky | 137/351 X |
| 4,054,210 | 10/1977 | Crocker | 414/22 |
| 4,082,193 | 4/1978 | Teague | 414/22 |
| 4,099,630 | 7/1978 | Beck | 414/22 |
| 4,212,576 | 7/1980 | George | 414/22 |
| 4,332,411 | 6/1982 | Ellzey | 414/745 X |

FOREIGN PATENT DOCUMENTS

| | | | |
|---|---|---|---|
| 581085 | 11/1977 | U.S.S.R. | 414/918 |

*Primary Examiner*—Leslie J. Paperner

*Attorney, Agent, or Firm*—Pravel, Gambrell, Hewitt & Kimball

[57] ABSTRACT

An apparatus for picking up and laying down drill pipe casing and the like having a single endless line and support means extending axially of the apparatus toward the drilling rig to move the pivot point of the apparatus rearwardly thereof to increase its resistance against tipping under load. The apparatus also comprises a means for safely loading and unloading a trough and a support pole from the unit.

6 Claims, 13 Drawing Figures

PICK-UP AND LAYDOWN MACHINE

An apparatus for picking up and laying down drill pipe casing and the like having a single endless line and support means extending axially of the apparatus toward the drilling rig to move the pivot point of the apparatus rearwardly thereof to increase its resistance against tipping under load. The apparatus also comprises a means for safely loading and unloading a trough and a support pole from the unit.

BACKGROUND OF THE INVENTION

Picking up and laying down drill pipe casing and other tubular goods in the drilling of oil and gas wells requires extreme caution both to protect the personnel on the rig and also to protect the pipe threads from damage. As the projected depth of the wells being drilled increases, the height of the rig floor increases to accommodate additional blowout preventers and other equipment required. To accommodate picking up and laying down pipe, particularly on these higher rig floors, larger and more sophisticated pick up and laydown equipment is required to handle the greater heights and the steeper angles of approach from the catwalk to the rig floor. If the angle of approach is too steep, the upper end of the joint of pipe will be too high above the rig floor for a worker standing on the floor to safely reach and therefore means are required to raise the rear end of the pickup line to lower the angle of approach to the elevated rig floor and also to lower the upper end of the pipe with respect to the rig floor. A number of the prior art pick up and laydown machines have a fixed angle of approach and are exemplified by U.S. Pat. Nos. 4,054,210; 4,099,630 and 4,082,193. Many of these devices must be positioned immediately adjacent and anchored or secured to the catwalk or some other support structure to resist an overturning moment or movement horizontally.

On many locations the controls for the operation of the blowout preventers or other equipment are positioned at the outer end of the catwalk where pick up and laydown machines are normally positioned and therefore the catwalk cannot be used to stabilize the pickup and laydown machine and provide the means for resisting tipping of the pick up unit under load.

SUMMARY OF THE INVENTION

The present invention provides a single endless line mounted on a drum carried by an extendable boom to allow the lower end of the pick up line to be raised to an elevation above the pick up unit and thus decrease the angle of approach of a joint of pipe being picked up from a catwalk for delivery to the rig floor. Also, the extendable boom increases the range of lifting height from the catwalk to an inclined position for delivery to the rig floor. Reducing the angle of approach not only facilities positioning the upper end of the pipe for handling safely by the rig crew on the rig floor but also allows the pick up line to operate with less tension than might otherwise be required. This reduces the load on the pick up line and also reduces the tendency for the pick up unit to tip due to such load. The present invention also provides extendable support means adapted to be moved rearwardly relative to the pick up unit to move the pivot point away from the unit and toward the rig, and toward the load, to increase the pivot arm resisting the tipping moment imposed by the load of the pipe as it is being carried from the catwalk to the rig floor. The extensible support also includes a vertical support member with over-the-center lock means for locking the support in an extended position for vertically imposing a load on the ground.

DESCRIPTION OF THE PREFERRED EMBODIMENT

Figure 1:
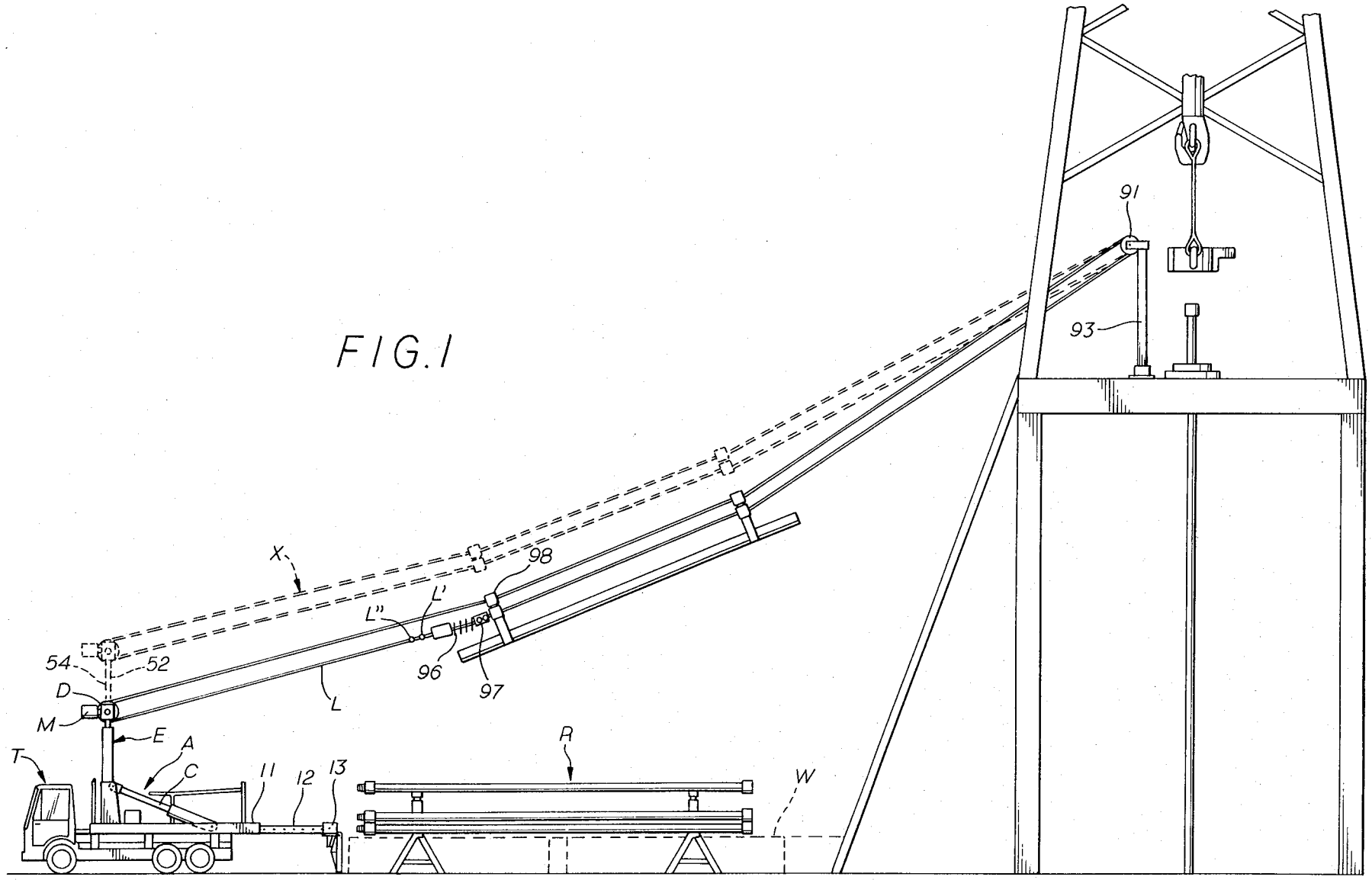
FIG. 1 is a side elevation showing the pick up and laydown apparatus of the present invention rig in position adjacent a catwalk and rig floor.

The present invention comprises a pick up and laydown machine X for picking up and laying down oilfield pipe or tubular goods between a catwalk adjacent the pipe rack R and an elevated rig floor F. Such apparatus includes a power unit A which is mounted either on a truck T or, if desired, a skid (not shown).

The pick up unit is mounted on a base B which includes horizontal members which are adapted to be positioned on a truck bed or on the ground and are substantially parallel to the axis between the pick up unit and the rig floor when the unit is set up for operation. The base is preferably made of tubular members 11 which are generally square in crosssection. These square tubular base members telescopically receive extensible supports 12 which are generally parallel to one another and which are joined together at their outer ends by a transverse member 13. The extensible supports are provided with a plurality of spaced openings 14, preferably horizontally aligned, for receiving a pin or pins or locking means to hold the supports in the extended position and to resist retraction under load. The base tubes 11 are preferably provided with spaced rollers 16 at the outer open end (FIG. 2) and the support tube 12 is also preferably provided with a roller 18 at or near the rear end 20 to facilitate extension and retraction of the extensible supports 12 relative to the base 11.

Figure 6:
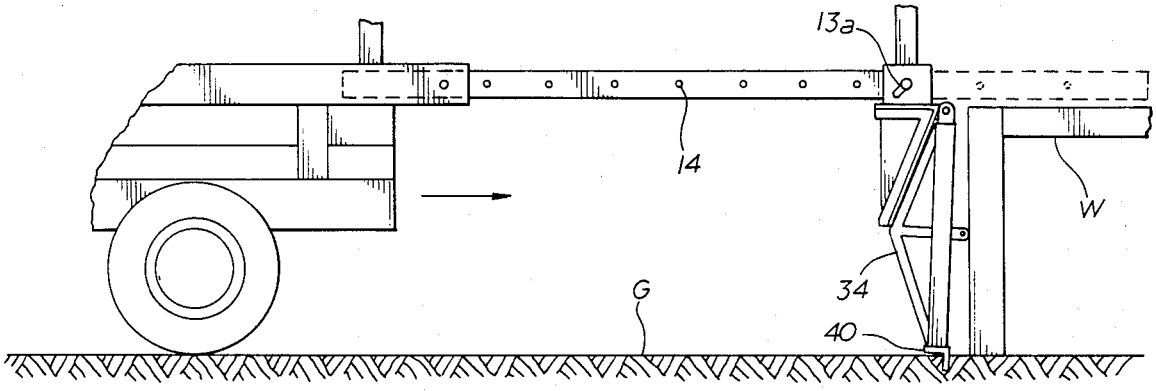
FIG. 6 is a partial view of the rear of the truck mounted pick up apparatus showing the extended support means for the vertical support in the locked position and also showing the extension means extending through the transverse plate of the vertical support and positioned on the top of a catwalk.
Figure 7:
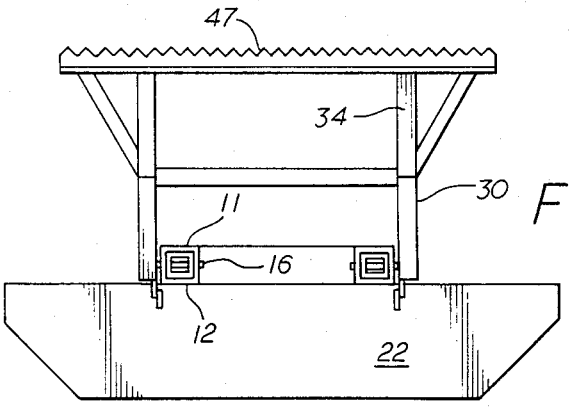
FIG. 7 is a view taken on line 7—7 of FIG. 4 showing the vertial support means in the upright position for travel on the rear of the truck bed.
Figure 8:
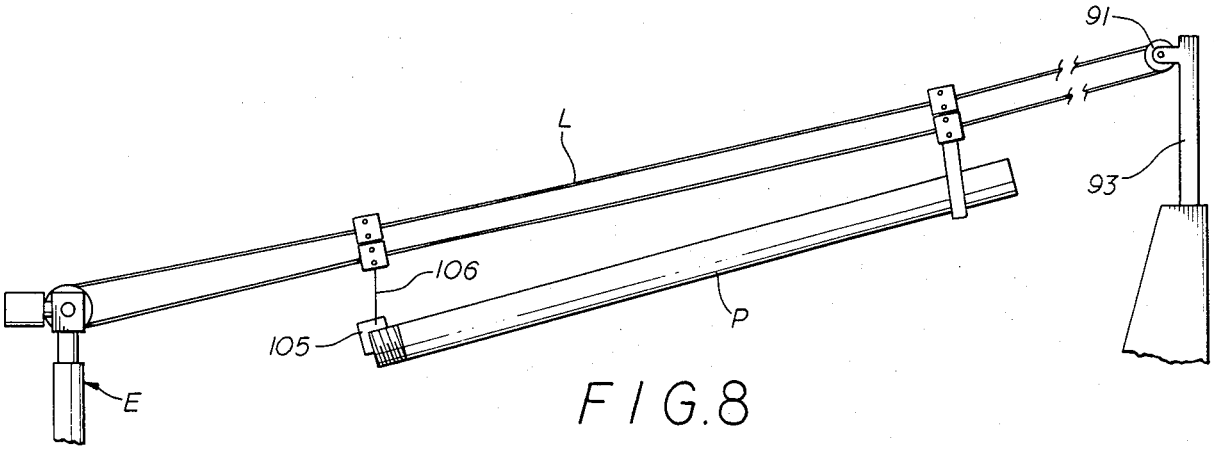
FIG. 8 is a partial side elevation showing the support line of the pick up and laydown apparatus with the carriages mounting a pair of hooks supporting a joint of pipe.

The movable transverse member 13 connecting the extensible supports 12 together at their outer end includes an inclined tail board 22 which provides a surface for receiving an angular leg 30 of the vertical support means 33. Such vertical support means 33 includes a pair of legs which are pivotally mounted at the rear end of the extensible support 12 and which support legs are connected together at their lower ends by a transverse member 40 which will be described in more detail hereinafter. The legs preferably comprise triangular truss members including a longitudinally extending base leg 35 and a pair of inclined shorter legs 30 and 34 which are joined to opposite ends of the base legs to form the triangular shape truss member shown in FIG. 4. An internal support 37 may also be included in each of the trusses. The angle of the upper inclined leg 30 when combined with the angle of the inclined rear tailboard 22 positions the truss leg 33 such that the long leg 35 is disposed at an angle of less than ninety degrees to accommodate the over-the-center locking arrangement referred to herein. The base leg 35 is longer than the vertical distance of the extensible supports 12 above the ground G to provide vertical support when in the inclined position shown in FIG. 6. With this arrangement the unit may be positioned at a desired point relative to the rig floor and catwalk with the extensible support extended some desired distance and locked in position by means of pins through the horizontal aligned holes. Suitable openings are provided near the rear of the base 11 for receiving the lock pins 16 by which the extensible members are locked in their extended position (FIG. 7).

Figure 4:
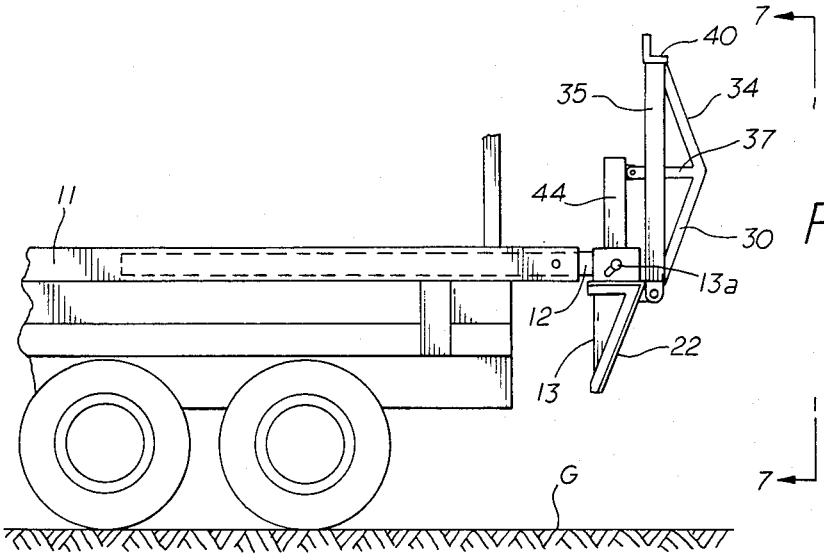
FIG. 4 is a partial view of the rear of the pick up and laydown apparatus showing the extension means for supporting the rear of the support means in an elevated position on the truck bed.

As shown in FIG. 4, the base legs 35 are provided with ears 44 and pin holes 46 for locking the vertical support trusses in an upright position for travel purposes.

Figure 5:
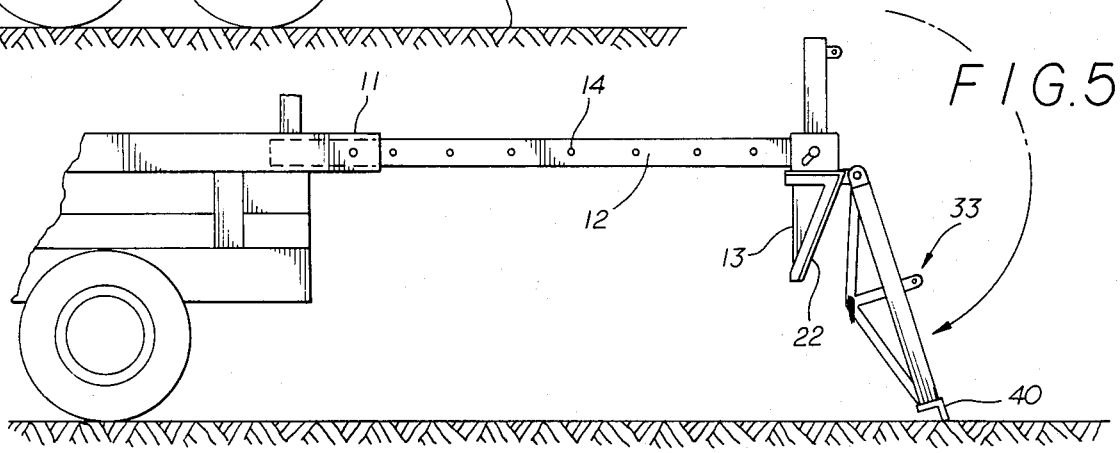
FIG. 5 is a partial view of the rear of the truck with the extensible support means extending and in a partially erected position.

The transverse member 40 connecting the lower ends of the vertical support legs 33 is preferably a blade having a plurality of projections 47 forming a serrated edge thereon for gripping or engaging the ground when the extendible supports are deployed in an extended position relative to the base. To put the vertical support legs 33 in the support position, the pins securing the vertical support legs in the upright travel position are released and the legs 33 are swung outwardly and downwardly either by means of a line or some other temporary support means to enable them to swing around to a position with the blade engaging the ground (FIG. 5). Thereafter, the unit is moved backward and the blade 40 digs into the ground G and raises the extensible support 12 slightly while the legs 33 are being pivoted into the over-the-center lock position which the legs 33 take when the angle leg 30 engages the inclined angle 22 on the tailboard. In that position the weight of the extensible supports and any load imposed thereon by the lifting or lowering operation will hold the legs 33 in their over-the-center locked position as shown in FIG. 6 of the drawings.

The boom E which carries the drum D about which the endless line L is rove is pivotally mounted on the base B and has cylinder means C for raising and lowering the boom as desired. The endless line has a means for carrying joints of pipe, either a pair of hooks or a longitudinally extending trough F, whichever is desired. The boom E of the present invention comprises a telescoping boom having a lower base 50 which is pivotally mounted to the base B and an upper section 52 which is telescopically mounted to the lower base and which carries the drum D on which the line L is rove. The pivotal mounting means 60 for the inner base comprises a steel pin having a brass sleeve or exterior and a steel sleeve is secured in the boom base for receiving the brass clad pin. Thus, it will be appreciated that the wear piece, i.e., the brass clad pin, is more easily removed for repair, reworking or replacement than reworking the large boom base 50.

Figure 12:
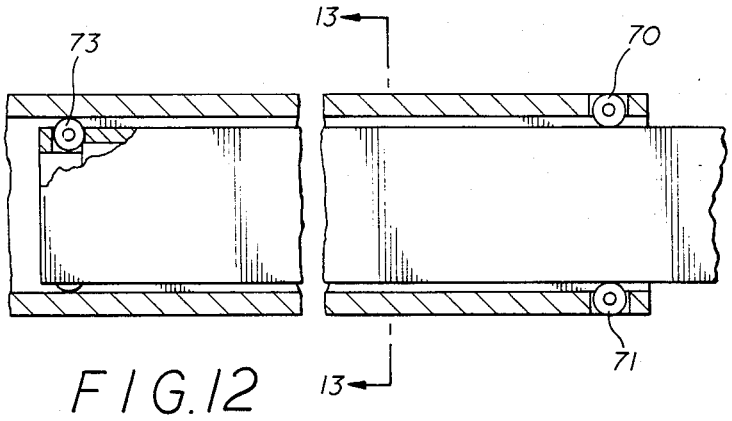
FIG. 12 is a view partially in elevation and partially in section showing the low friction rollers for telescopically mounting the upper telescoping member of the boom and the lower telescoping section.
Figure 13:
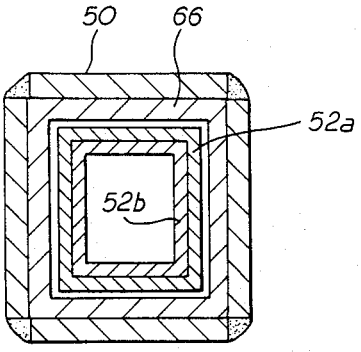
FIG. 13 is a sectional view taken along 13—13 of FIG. 12 showing further details of the boom construction.

As shown in FIG. 13 the boom base includes a removable tube portion 66 which is preferably of substantially square crosssection and is welded or otherwise secured to the base member 50. Telescopically received in the removable square tube is a smaller laminated square tube 52 which is formed of a mild steel inner tube **52*b* and a high strength steel exterior tube 52*a* with the two tubes being welded together. In the event of an overload failure causing the relatively more brittle high strength steel 52*a* to snap, the ductile inner steel tube 52*b* will bend and deform without suddenly dropping the load. As shown in FIG. 12, the base tube 66 is provided with upper and lower rollers 70 and 71, respectively, positioned near its outer end and the laminated telescoping inner tube 52 has a roller 73 mounted on the upper side of its rear end to facilitate telescopically extending and retracting the inner tube 52 relative to the base tube 50 with a minimum of wear on the respective tubes. The upper tube or boom section 52 is provided with openings 54 for receiving pin means for locking the upper member 52 in its extended position relative to the inner boom base 50** to mechanically lock the booms in the selected extended position.

A double acting hydraulic cylinder 80 is mounted in the telescoping upper and lower boom members 50 and 52 for extending and retracting the upper member 52 relative to the base member 50. The upper member 52 supports the rotatable drum D on which the single line L is rove and such drum is rotated by a hydraulic motor M which is supplied hydraulic fluid through hoses 77 extending along the exterior of the upper and lower boom sections 50 and 52. A tension means 82, such as a stretchable rubber strap or cylinder, is secured to the hydraulic hoses 77 approximately midway of their length and the inner end of the strap 82 is secured to the lower boom housing 50. A roller 84 is mounted on an arm 85 which projects outwardly from the lower boom section 50 to provide a low-friction guide for the tension strap to prevent chafe or wear on the strap and to distribute tension stress throughout the length of the tension means. The tension means holds the upper portion of the hydraulic lines 77 adjacent the outer boom portion in tension at all times.

Figure 2:
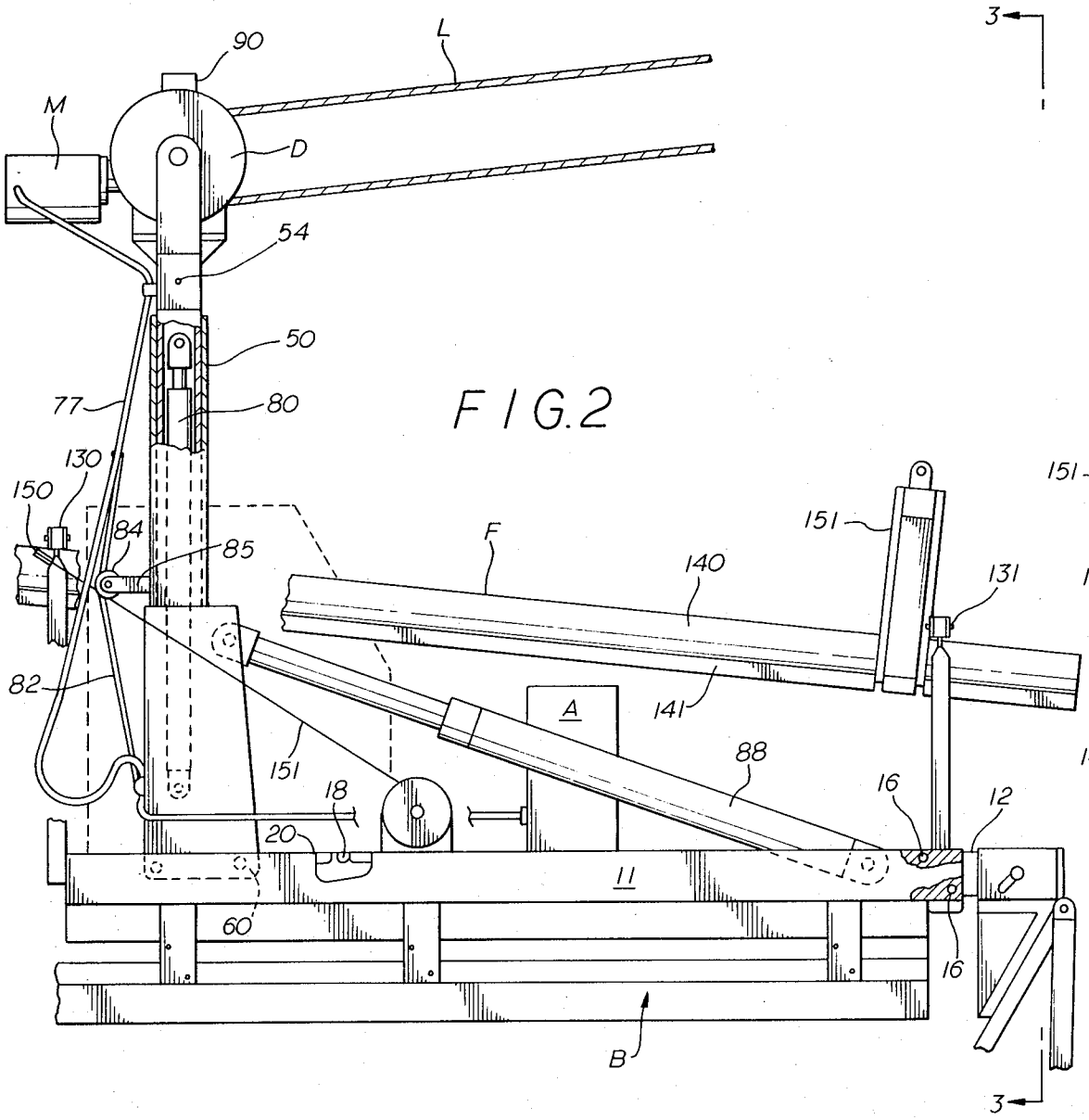
FIG. 2 is a partial view of the pick up and laydown apparatus illustrated in FIG. 1 partly in section and partly in elevation.

Also, as shown in FIG. 2 the base section of the boom 50 is connected to hydraulic cylinders 88 for raising and lowering the boom, as desired. Suitable valve means 161 and flowlines 160 are also provided to enable hydraulic fluid from the rod end of the cylinders to be combined with oil from the hydraulic pump (not shown) to increase the speed for raising and lowering the pivoted boom base, if desired. Also, the drum is provided with a caliper brake 90 which is spring actuated to engage the circumference of the drum to hold it against rotation when it is not being intentionally rotated. Such spring actuated brake mechanism 90 has a hydraulic override which causes the spring to be released whenever the hydraulic fluid pressure causes the drum to rotate in either direction. Also, a manual override is provided to lock out the spring actuated brake 90.

As shown in FIG. 1 of the drawings the endless cable L is rove around the drum D and is also rove around the sheave 91 on a pole 93 positioned above the rig floor. A pusher block 94 is secured to the line L approximately where its ends L' and L" are connected together, and a large spring 96 which is positioned around the cable with a rubber bumper pad 97 in front for cushioning the load impposed on the line, is used to push the rear carriage 98 on which a rear hook or rear end of a trough, is suspended when pipe is being picked up. The carriage 98 is comprised of two sets of rollers which are secured between parallel plates forming the carriages 98 and 99. A clamp 100 is secured to the line L behind the front carriage 99 to stop further movement of the line L in the forward direction when the front carriage 99 reaches the sheave 91 over the rig floor. Thus when a driller picks up the front end of the pipe with the elevator and the rear end of the pipe is supported by a rear hook H, which must continue to travel up the line L with the pipe as the front of the pipe is lifted or the rear end of the pipe will swing free of its hook and fall against the rig.

The present invention also includes a special rear pipe support or hook 105 with means for frictionally gripping the rear end of the pipe to prevent its coming lose and swinging free after the front end of the pipe has been picked up by the driller. Such rear hook 105 includes a steel plate adapted to be supported by a short cable 106 from the rear carriage block 98. The plate has a transverse slot 109 therein with friction means 110 gripping the pipe P. As shown in the drawing (FIG. 9) the preferred friction means is a bow spring secured in the slot for gripping a pipe which is inserted into the slot. Adjustment means, such as a screw 112, are provided for adjusting the tension on the bow spring 110 to accommodate various wall thicknesses of a different size oilfield pipe. A handle 114 is provided on the opposite edge of the plate from the slot 109 to facilitate manually attaching and also removing the hook from the pipe. An alternative embodiment of the holding means in the rear hook 105 include a permanent magnet on a spring loaded arm for engaging and securing the hook and pipe together. The present invention also includes a means for loading and unloading the pole 93 which is positioned in the mousehole in the rig floor during operation of the pick up and laydown machine and the longitudinally extending trough F in which the pipe is sometimes carried. Each device is heavy and therefore difficult and somewhat dangerous to load and unload from the pick up and laydown machine.

Figure 3:
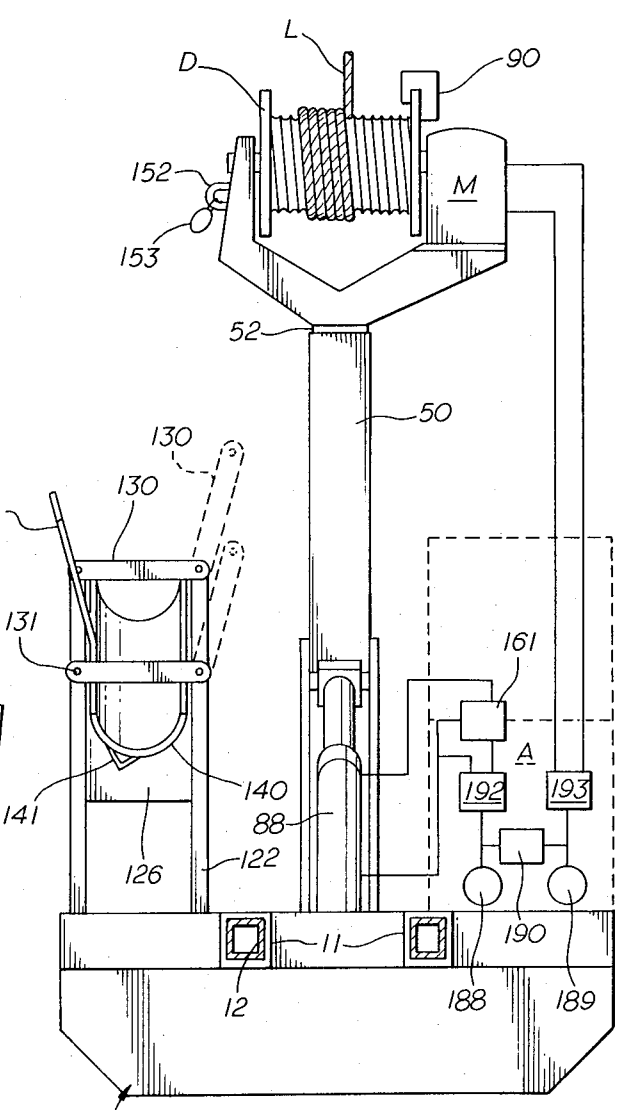
FIG. 3 is a view taken on line 3—3 of FIG. 2 showing additional details of the pick up and laydown apparatus of the present invention.

As shown in the drawings a wench 120 is mounted on the base to one side of the pick up boom and a support frame comprising two spaced pairs of upstanding support legs 122 and 124, respectively are also mounted on the base B. Each of the pairs of legs is connected by transverse plates 126 for receiving the lower side of the longitudinal extending trough F and each pair of legs has a pivoted upper bar 130 which in the down position extends across the top of the stored trough F and is locked by a pin 131 or other suitable locking means. In the up position (indicated by dotted line in FIG. 3) the bars 130 act as inclined guides for guiding the trough F and/or the pole 93 into position in the end plates 126. After storage, the inclined bars are pivoted over and locked down across the top of the trough F to hold it in position for travel. The trough has a curved lower surface 140 and has angle bars 141 secured along its bottom to provide a line about which the trough pivots for unloading a joint of pipe on the catwalk. The end plates have a concave curved surface interrupted by a "V" shaped groove for receiving the curved bottom trough and the associated angle bar. One rear leg 124 has a sheave or pulley 150 attached at its upper end which serves as a turning block for the line 151 on the wench 120; so, the upper boom 52 includes an eye 152 on one side for receiving a snatch block 153 or other type block for guiding the wench line 151. The boom may be raised and extended to the desired elevation for guiding the line 151 and loading and unloading the trough F and the pole 93.

In operation of the apparatus of the present invention, the pick up and laydown unit X which is preferably mounted on a truck T is moved into position on location and the supports 12 are moved outwardly relative to the base B the desired distance and the pins placed through the horizontal openings to lock the supports 112 in the extended position shown in FIG. 4. Thereafter, the vertical support legs 33 are pivoted downwardly to engage the ground G and the truck T is then moved backward causing the rear end of the supports to rise as the vertical leg 33 passes over center (FIG. 5) and the rear end of the supports 12 then moves downwardly so that the inclined leg 30 of the truss engages the inwardly and downwardly inclined surface 22 on the tailboard 13 of the support apparatus. In this position the weight of the supports 12 as well as the load that is imposed on the overhead cable L acts to lock the over-the-center arrangement of the rear supports legs in position to provide a rear vertical support for the support legs 12 and to facilitate resisting the overturning moment imposed by any load on the overhead cable. It will be appreciated that moving the vertical support leg rearwardly of the truck unit extends the center of pivot which opposes an overturning moment imposed by the load supported by the overhead cable rearwardly relative to the pickup and laydown unit and in the direction of the drilling rig floor and/or the sheave on the pole mounted in the rig floor. With this arrangement larger loads can be handled by a pick up and laydown unit mounted on a smaller truck than would otherwise be required where the mass or weight of the truck is used to counterbalance or offset the load on the overhead line imposed by a drill collar or other heavy objects carried by such line.

With the unit thus set up at or beyond the end of the catwalk the pole 93 is removed from the trough F which is normally stored in the pick up and laydown unit X and the trough F is also removed by using the wench 120 and its line 151 in conjunction with the snatch block 153 on the boom. After the pole 93 and the trough F are removed from the truck T the pole is rigged in the rig floor and the line or cable L carried on the drum is unwound and rove over the sheave on the post and then connected to the other end to form an endless line extending from the drum D to the sheave and back to the drum with a sufficient number of turns of cable on the drum D to provide adequate friction to move the load carried by the line, and to adjust the length of over-hanging line required.

Depending upon the height of the rig floor above the catwalk and the position of the pick up and laydown unit with respect to the end of the catwalk and its total distance from the rig floor, the operator selects the desired length of the telescoping boom to be employed for that particular job and the upper end 52 of the boom telescoped out to the desired distance and pinned in place with respect to the base portion 50 of the boom and thereafter the boom is pivoted upwardly and downwardly by means of its pivoting hydraulic cylinder 88.

With the boom pivoted to substantially a horizontal position or to its lower position as the case may be the endless line L is slacked to the point that the hooks or trough which are used with the line are lowered to the catwalk to enable a joint of pipe on the catwalk to be placed in such hooks or a trough. Thereafter the boom pivoted upwardly tensioning the line L and when sufficient tension is on the line the drum D is caused to rotate moving the carriage and the pipe upwardly from the catwalk to the position with the upper end of the pipe adjacent to the edge of the rig floor. Thereafter the pipe is connected to the travelling block by a line or other suitable means and as the driller lifts the front end of the pipe the rear end is drawn out of the trough, or if the pipe is carried by a hook 105, such hook is moved upwardly along the cable to support the rear end of the pipe as the front of the pipe is lifted in the derrick.

With the apparatus of this invention the single line is provided with a pusher block which pushes the carriage which supports the rear end of the trough or the rear end of the pipe as the case may be upwardly toward the rig floor and when the front end of the trough or the forward carriage reaches the sheaves, the line stops moving and the pipe is either drawn out of the trough or is lifted as described hereinabove and the rear hook travels upwardly along the stopped line to a point adjacent the forward hook where the crew on the rig floor can disengage the rear hook from the joint of pipe.

Figure 9:
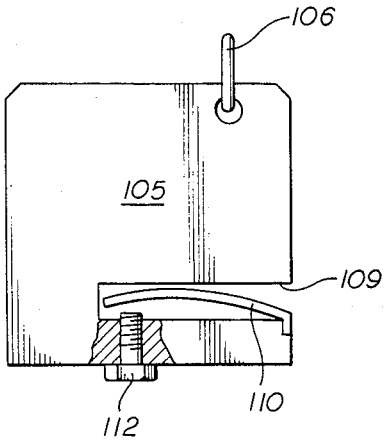
FIG. 9 is an enlarged view of the rear hook shown in FIG. 8.
Figure 10:
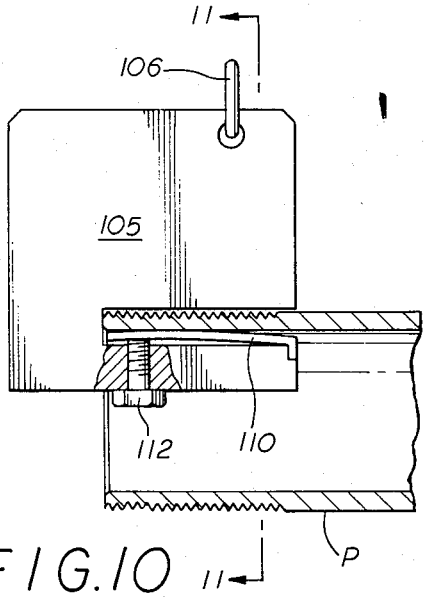
FIG. 10 is another enlarged view of the rear hook mounted on the end of a joint of pipe.
Figure 11:
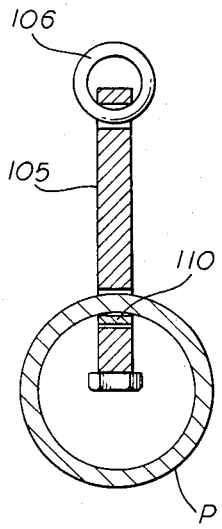
FIG. 11 is a view taken on line 11—11 of FIG. 10 showing further details of the rear hook.

As shown in FIGS. 9 and 10 of the drawings the rear hook comprises a spring tension means for frictionally gripping or engaging the rear end of the pipe inserted into the slot in the hook to attach the hook to the rear of the pipe with sufficient frictional grip to maintain a connection between the pipe and the hook as the pipe pulls the hook and its associated carriage block up the stopped line. It is important in this regard to note that the gripping friction between the pipe and the hook must be greater than the friction imposed between the roller carriage and the lines to prevent the pipe from being pulled out of the hook. Those familiar with pick up and laydown machines will understand that this procedure is substantially reversed in laying pipe down that is the lower end of the pipe suspended in the derrick is inserted either into the rear hook or into the trough, as the case may be and the pipe is then lowered to a point where it is then inserted into the forward hook or laid in the trough and released from the pick up line in the derrick thereafter the drum is rotated in an opposite direction and the pipe is lowered to a position over the catwalk and thereafter the drum and the boom are lowered to lower the pipe to position for unloading on the catwalk.

An alternative embodiment shown in FIG. 6 shows the support arms 12 extending rearwardly of the movable transverse support 13 and positioned on top of the catwalk W. Such arms are pinned to the movable transverse support 13 by pins 13*a* and may be further secured to the catwalk with the winch line 151 or with chain and booms, as desired. It will be appreciated that the transverse member set against the end of the catwalk arrests the longitudinal movement of the pick up and laydown machine in a direction toward the rig. Dual hydraulic pumps 188 and 189 are provided, one for primarily operating the boom controls such as pistons 80 and 88 and the other primarily operating the rotation of the drum D. Suitable flow control valve 190 provided for combining fluid from the boom circuit with hydraulic fluid from the drum circuit to speed up the rate of rotation of the drum D.

I claim:

1. In a pick up and laydown machine having a boom pivoted with respect to a support base and carrying a drum with a single line rove about the drum and about a sheave mounted above the derrick floor and means for pivotally raising and lowering the boom and means for rotating the drum to move the line and with means carried by the line to move a joint of pipe from a position adjacent a catwalk beside the rig to a position partially above the rig floor the improvement comprising the telescoping boom carrying a drum on which an endless line is rove, said telescoping boom having a lower base section and an upper section and means for extending and retracting said upper section with respect to said lower section, and said upper section comprises a laminated member wherein the inner layer is formed of mild steel and the outer layer is formed of high tensile steel.

2. In a pick up and laydown machine having a boom pivoted with respect to a support base and carrying a drum with a single line rove about the drum and about a sheave mounted above the derrick floor and means for pivotally raising and lowering the boom and means for rotating the drum to move the line and with means carried by the line to move a joint of pipe from a position adjacent a catwalk beside the rig to a position partially above the rig floor the improvement comprising the telescoping boom carrying a drum on which an endless line is rove, said telescoping boom having a lower base section and an upper section and means for extending and retracting said upper section with respect to said lower section, and said support base includes hollow tubular members extending substantially axially with respect to the direction of pull on said endless line and a plurality of extensible support arms are telescopically mounted within said tubes and are joined together at their outer end by a transverse member having a pair of pivotally mounted legs for providing vertical support to said support arms and having their free end secured together and inclined guide means with said transverse member for stopping rotation of said pivoted leg after rotation thereof more than ninety degrees from horizontal to provide an over-the-center lock for said legs.

3. The invention of claim 2, wherein said support arms form a triangular truss with one leg of said triangle engaging said inclined guide means to impose a load on said trusses vertically when the base leg of said truss is in an over-the-center position.

4. In a pick up and laydown machine having a boom pivoted with respect to a support base and carrying a drum with a single line rove about the drum and about a sheave mounted above the derrick floor and means for pivotally raising and lowering the boom and means for rotating the drum to move the line and with means carried by the line to move a joint of pipe from a position adjacent a catwalk beside the rig to a position partially above the rig floor the improvement comprising the telescoping boom carrying a drum on which an endless line is rove, said telescoping boom having a lower base section and an upper section and means for extending and retracting said upper section with respect to said lower section, and said drum is mounted on the upper boom section together with drive means for rotating said drum and flexible hydraulic supply lines extend from a point of attachment on said lower boom section to said drive means and tension means are provided for maintaining said flexible supply lines in tension, said tension means includes a stretchable rubber strap having one end secured to said flexible hydraulic supply lines and the opposite end connected to said lower boom section.

5. The invention of claim 4, including a roller mounted laterially of said boom and intermediate of the end of said rubber strap for engaging and guiding said rubber strap.

6. In a pick up and laydown machine having a boom pivoted with respect to a support base and carrying a drum with a single line rove about the drum and about a sheave mounted above the derrick floor and means for pivotally raising and lowering the boom and means for rotating the drum to move the line and with means carried by the line to move a joint of pipe from a position adjacent a catwalk beside the rig to a position partially above the rig floor the improvement comprising the telescoping boom carrying a drum on which an endless line is rove, said telescoping boom having a lower base section and an upper section and means for extending and retracting said upper section with respect to said lower section, means for loading a trough and unloading said trough on said pick up and laydown unit, said loading means includes a wench and line and guide means for said line supported above the base of said pick up and laydown unit, and said guide means are positioned on said telescoping boom.

* * * * *